US007404348B2

(12) United States Patent
Dietz et al.

(10) Patent No.: US 7,404,348 B2
(45) Date of Patent: Jul. 29, 2008

(54) CUTTING TOOL

(75) Inventors: Holger Dietz, Krefeld (DE); Horst Hohnen, Schwalmtal (DE)

(73) Assignee: Heidel GmbH & Co. KG Werkzeug-u. Maschinenfabrikation, Viersen (DE)

( * ) Notice: Subject to any disclaimer, the term of this patent is extended or adjusted under 35 U.S.C. 154(b) by 0 days.

(21) Appl. No.: 11/016,587

(22) Filed: Dec. 17, 2004

(65) Prior Publication Data

US 2005/0126360 A1 Jun. 16, 2005

Related U.S. Application Data

(60) Continuation of application No. 10/718,957, filed on Nov. 21, 2003, now abandoned, which is a division of application No. 10/117,461, filed on Apr. 5, 2002, now abandoned.

(30) Foreign Application Priority Data

Jan. 25, 2002 (DE) ..... 202 01 196 U
Feb. 5, 2002 (DE) ..... 202 01 757 U
Feb. 18, 2002 (DE) ..... 202 02 524 U

(51) Int. Cl.
*B26D 3/06* (2006.01)

(52) U.S. Cl. ..... 83/169; 83/875; 83/581

(58) Field of Classification Search ..... 83/169, 83/877, 875, 878, 940, 941, 581, 22
See application file for complete search history.

(56) References Cited

U.S. PATENT DOCUMENTS 274,957 A * 4/1883 McMurty ..... 72/463
1,779,876 A * 10/1930 Gay ..... 83/169
3,830,122 A * 8/1974 Pearl ..... 83/169
4,168,241 A * 9/1979 Kozima et al. ..... 508/129
4,261,285 A * 4/1981 Pearl ..... 118/37
4,448,808 A * 5/1984 Pearl ..... 427/208.6
4,608,891 A * 9/1986 Frisby et al. ..... 83/56
5,087,261 A * 2/1992 Ryd et al. ..... 606/82
5,409,491 A * 4/1995 Boehringer et al. ..... 606/82
5,426,854 A * 6/1995 Leini et al. ..... 30/123.4
5,584,216 A * 12/1996 Sinjen ..... 83/62.1
5,845,402 A * 12/1998 Leini ..... 30/123.4
6,128,990 A * 10/2000 Drew et al. ..... 83/168

FOREIGN PATENT DOCUMENTS

JP 02030418 * 1/1990

* cited by examiner

*Primary Examiner*—Kenneth Peterson
(74) *Attorney, Agent, or Firm*—Friedrich Kueffner

(57) ABSTRACT

The cutting tool for polyurethane elastomers, which is controllable manually or program-controlled comprising a cutting head (10) with a driving device (20), a blade holder (30) with a cutting knife (35) has at least one cutting head. The driving device has a driving motor (21) with a drive shaft (22) running in cutting head longitudinal axis (L), a cam disk actively connected with the drive shaft (22) of the driving motor (21), driven rotating about the drive shaft longitudinal axis (L2), with control surfaces (40, 41) configured on the side (25*a*) opposed to the driving motor (21) and lying in different planes, a roller (26) actively connected with one of the control surfaces (40. 41) of the cam disk (25), a lifting rod or tappet push rod (45) actuated by means of a spring (27) which is actively connected with the roller (26) and the cam disk (25) over a coupling piece (46) and which carries at its free end (45*a*) the blade holder (30) for the cutting knife (25).

7 Claims, 11 Drawing Sheets

CUTTING TOOL

CROSS-REFERENCE TO RELATED APPLICATIONS

This application is a Continuation Application of U.S. patent application Ser. No. 10/718,957, filed Nov. 21, 2003 now abandoned, which is a Divisional Application of U.S. patent application Ser. No. 10/117,461, filed Apr. 5, 2002 now abandoned.

This invention relates to a cutting tool according to the preamble of the claims 1 to 3.

By cutting materials such as for example polyurethane elastomers, polyvinyl chloride, TPO, TPU, TPE, TPE-E as a structure investment, a slush investment, a sprayed investment, a casting investment with such cutting tools, it has proved that the edges of the cut carried out in the material with the cutting blade glue together, what cannot be avoided with the known means and devices.

The aim of this invention is to create a cutting tool for the cutting of materials such as for example polyurethane elastomers, polyvinyl chloride, TPO, TPU, TPE, TPE-E as a structure investment, a slush investment, a sprayed investment, a casting investment with which the depth of the cut in the material to be cut is adaptable and which allows V-cuts in the material with different V-shapes. A further aim consists in the configuration of a cutting tool of the known type in such a way that the edges of the cut cannot glue together any longer and moreover that a quality control of the cut made in the material is possible.

The first aim is achieved for a cutting tool of the indicated type with the characteristics indicated in claim 1.

Accordingly the invention consists in that, according to claim 1, the cutting tool has at least one cutting head and whereby the driving device is configured in a way known in itself or consists of

- a driving motor with a drive shaft running in cutting head longitudinal axis,
- a cam disk connected with the drive shaft of the driving motor driven rotating around the drive shaft longitudinal axis with control surfaces lying in different planes, configured on the side opposed to the driving motor,
- a roller actively connected with the control surface of the cam disk,
- a lifting rod or tappet push rod actuated by means of a spring which is actively connected with the roller and the cam disk ovel a coupling piece and which carries at its free end the blade holder for the cutting knife.

whereby the lifting movement of the cutting knife is achieved by means of the cam disk.

The lifting rod or the tappet push rod is brought to stop on the control surfaces of the cam disk by means of the spring.

The cam disk has preferably two control surfaces with different heights of depression and elevation.

The number of elevations of the lifting rod or of the tappet push rod can be varied by changing the number of revolutions of the driving motor.

According to a further embodiment of the invention, the cutting tool is configured in such a way that, for producing V-cuts in the material to be cut, the cutting tool has two cutting heads, whereby both cutting heads are in an angular position to each other so that both cutting heads are at an angle with their longitudinal axles.

Furthermore, the angular position of both cutting heads can also be changeable.

Since the lifting movement of the cutting knife is controlled by a cam disk, no additional and expensive technical devices are necessary to cause the up and down movement of the cutting knife. Furthermore, the use of a cam disk has the advantage that the cam disk in the cutting head can be interchanged with cam disks with differently configured control surfaces and with differently configured recesses and elevations so that, depending on the respectively desired cutting depth, the travel of the cutting knife can only be changed by interchanging the cam disks.

Furthermore, the embodiment according to the invention in which the cutting tool has two cutting heads placed at a predetermined angle to each other is advantageous so that V-shaped cuts can be made in the material to work on by means of both cutting knives. By changing the angular position of both cutting heads to each other, the shape of the respective V-cut can be changed and thus be adapted to the respective requirements.

The further aim is achieved with a cutting tool which is configured in a way known in itself or according to claim 1 with the characteristics indicated in the claims 1, 2, 3 and 4.

Accordingly, the invention consists in that, according to claim 2, for a cutting tool a separating agent is introduced into the cut produced in the material by its cutting head.

According to claim 3, it is provided for that an anorganic or an organic fluorescent substance is introduced into the cut made in the material by the cutting head.

For the cutting tool according to claim 4, a metallic substance is introduced into the cut made in the material by the cutting head.

Furthermore, it is provided for, among others, to feed fluorescent substances and/or metallic substances together with the separating agent.

According to a further embodiment of the invention, the cutting tool has a feeding pipe for the separating agent placed on the cutting head or in the cutting head, whereby the feeding pipe is connected at the one end with a preferably micro metering system, while the other end of the feeding pipe runs into the area of the cutting knife.

With such a cutting tool configured according to the invention, the separating agent is fed in metered form into the cut area during the cutting process by the cutting knife so that the separating agent comes into the cut area, moistens the edges of the cut there and thus avoids that the edges of the material glue together.

The feeding of fluorescent substances and/or of metallic substances, in particular in connection with the separating agent, allows a quality control of the cut made in the material, whereby it is essentially the matter of detecting the residual wall thickness, i.e. the thickness of the wall which remains at the bottom of the cut in the material. In particular by using metallic materials, the quality control can be reliably carried out, while the thickness of the residual wall thickness can be measured by measurement. The metallic substance put into the cut together with the separating agent can be detected for example by ultrasonic measures, measures with X-rays, proximity switches. For this metallic substance, it is the matter of substances with properties which, for example by using ultrasonic methods, clearly differ from the behavior of plastics, i. e. from the material in which the cut is made. The residual wall thickness can also be measured by a sensory method. Other electric methods, electric field measurement methods tan also be used.

Therefore, a method is also included with which a quality control of the cuts can be realized which are made by means of the cutting tool in a material, in particular in a material consisting of plastics, in which a separating agent is brought into the cut namely by the cutting knife of the cutting tool or in another way, a fluorescent substance and/or a metallic subtance being added to the separating agent, for example as a powder. Subsequently, the depth of the fillet weld is measured for example by ultraviolet radiation or cut depth measures which are made up to the bottom of the cut or of the fillet weld and the obtained result is compared with the wall thickness of the material from which the residual wall thickness can be calculated (indirect method). It is also possible with the method to determine directly the residual wall thickness.

The measurement of the fluorescence can be carried out by means of absorption spectroscopy, fluorescence spectroscopy or excitation spectroscopy.

Further advantageous configurations of the invention are the subject matter of the subclaims.

Embodiments of the invention are represented in the attached drawings.

Figure 1:
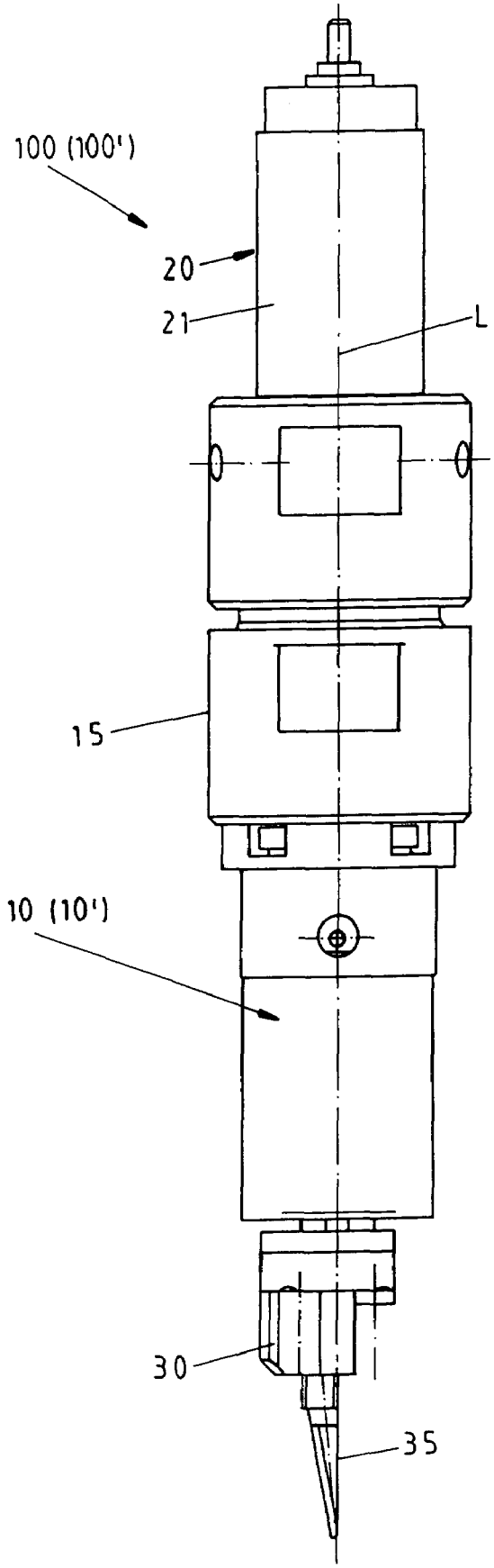
FIG. 1 is a view of the cutting head with a cutting knife of a cutting tool.

The cutting tool 100 according to the invention for materials 70, in particular for polyurethane elastomers, polyvinyl chloride, TPO or TPE (FIG. 9 and FIG. 10) is controllable manually or is program-controlled and comprises in a housing 15 a cutting head 10 with a driving device 20 which is configured as a driving motor 21, a blade holder 30 and a cutting knife 35 which is placed interchangeable in the blade holder 30 (FIG. 1, FIG. 2, FIG. 3, FIG. 4, FIG. 5 and FIG. 6). For the cutting tool 100 represented in FIG. 1 to 6, the cutting tool has at least one cutting head 10, whereby the cutting tool 100' can also be provided with two cutting heads 10, 10'—as shown in FIGS. 7 and 8.

Figure 2:
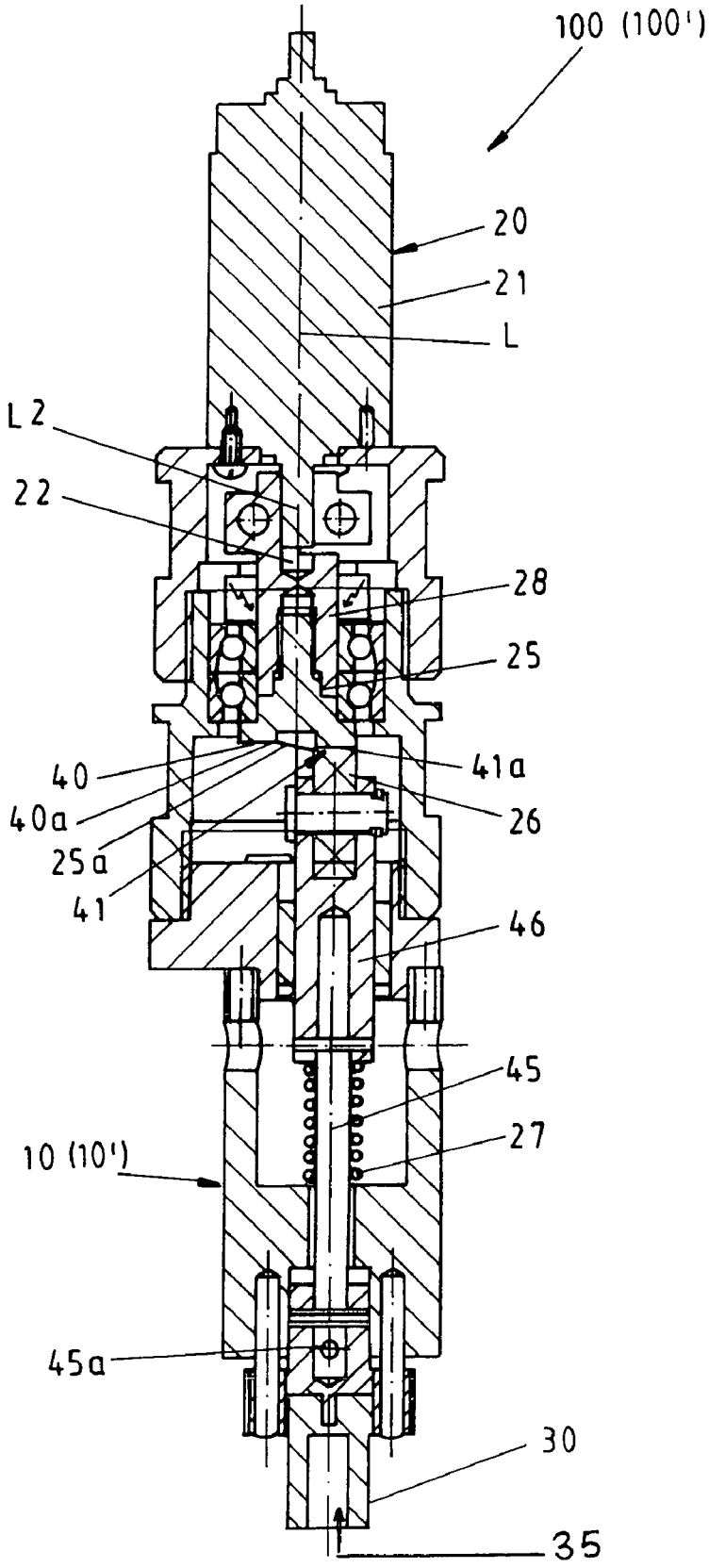
FIG. 2 is a vertical cut through the cutting head according to FIG. 1, however bv omitting the cutting knife.
Figure 3:
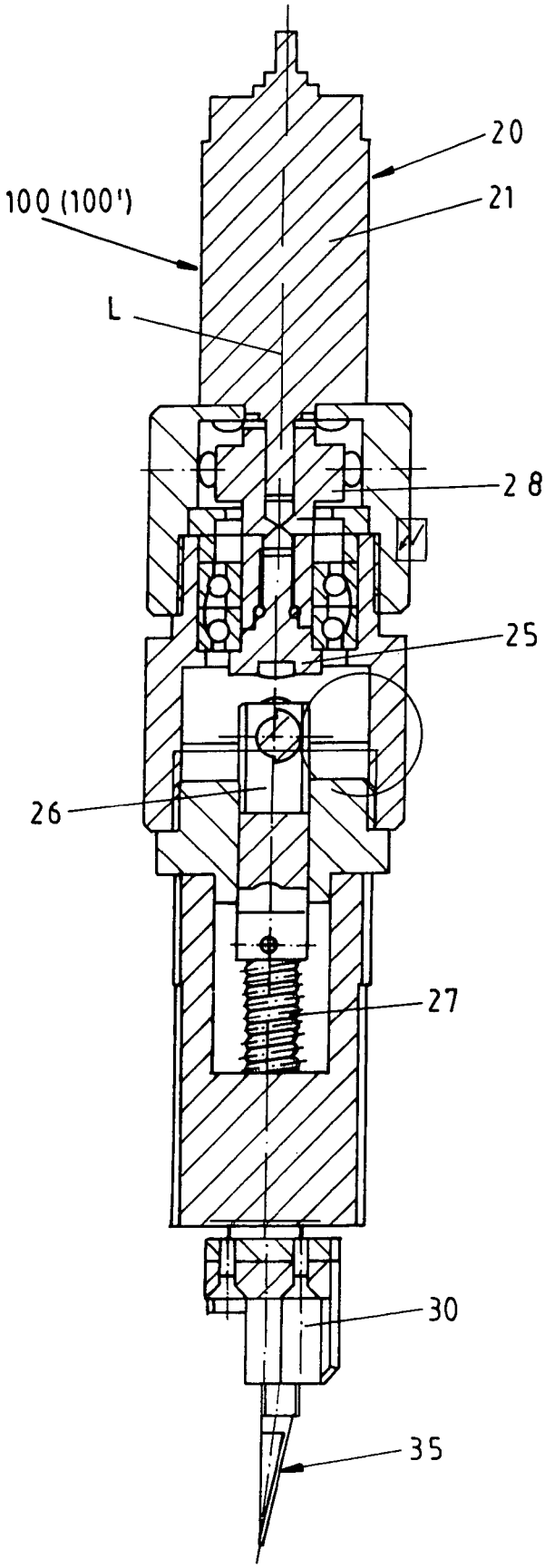
FIG. 3 is a vertical cut according to line A-A according to FIG. 2.
Figures 4, 5, 6:
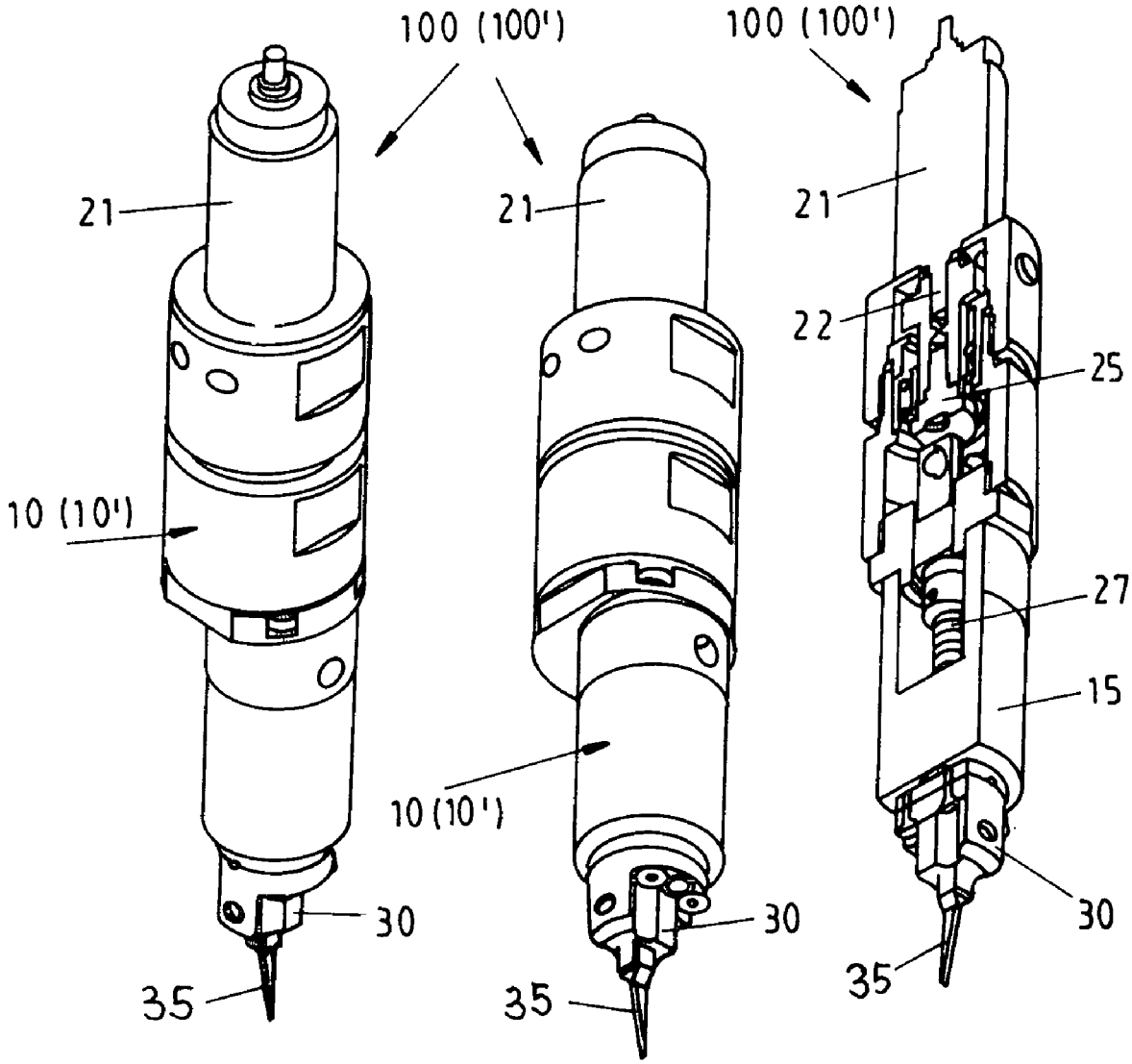
FIG. 4 and FIG. 5 show different graphic views of the cutting head.
FIG. 6 shows a vertical longitudinal cut through the cutting head in a graphic view.

The travel motion or the to-and-fro movement for the carrying out of the cut in the material 70 for the cutting knife 35 takes place by means of a driven cam disk 25. The driving device 20 for the blade holder 30 with the cutting knife 35 comprises a driving motor 21 with a drive shaft 22 running in cutting head longitudinal axis L. The cam disk 25 is actively connected with the drive shaft 22 of the driving motor 21. The cam disk 25 is driven circulating by means of the driving motor 22 over the drive shaft 22 about the drive shaft longitudinal axis L2 (FIG. 2). The cam disk 25 is thus perpendicular to the drive shaft 22 of the driving motor 21 and takes a horizontal position in the cutting head when the cutting head 10 takes a vertical operating position. On the side 25*a* opposed to the driving motor 21, in different surface planes lying control surfaces 40, 41 are configured, whereby in the embodiment shown in FIG. 2 two control surfaces 40, 41 in form of recesses 40*a* and elevations 41 are provided for, whereby these recesses 40*a* and the elevations 41*a* have different heights to each other. These recesses 40*a* and elevations 41 a change to each other over guiding surfaces so that an uniform travel movement is guaranteed for the cutting knife 35. The arrangement of the cam disk 25 in the cutting head 10 is so that the cam disk can be easily replaced by cam disks with differently configured control surfaces. For supporting the rotating movement of the cam disk 25, the cam disk is positioned in a corresponding manner and is connected by means of a coupling piece 38 with the free end of the drive shaft 22 of the driving motor 21.

The cam disk 25 is actively connected with its control surfaces 40, 41 over a roller 26 with a lifting rod or a tappet push rod 45 which carries, at its free end 45*a*, the blade holder 30 with the cutting knife 35. The lifting rod or the tappet push rod 45 is pushed by means of a spring 27 against the roller 26 and thus against the control surfaces 40, 41 of the cam disk 25 so that the travel movement.of the cutting knife 35 is carried out over the control surfaces 40, 41 of the cam disk 25. The number of elevations of the lifting rod or of the tappet push rod 45 can be changed by changing the number of revolutions of the driving motor 21.

Figure 7:
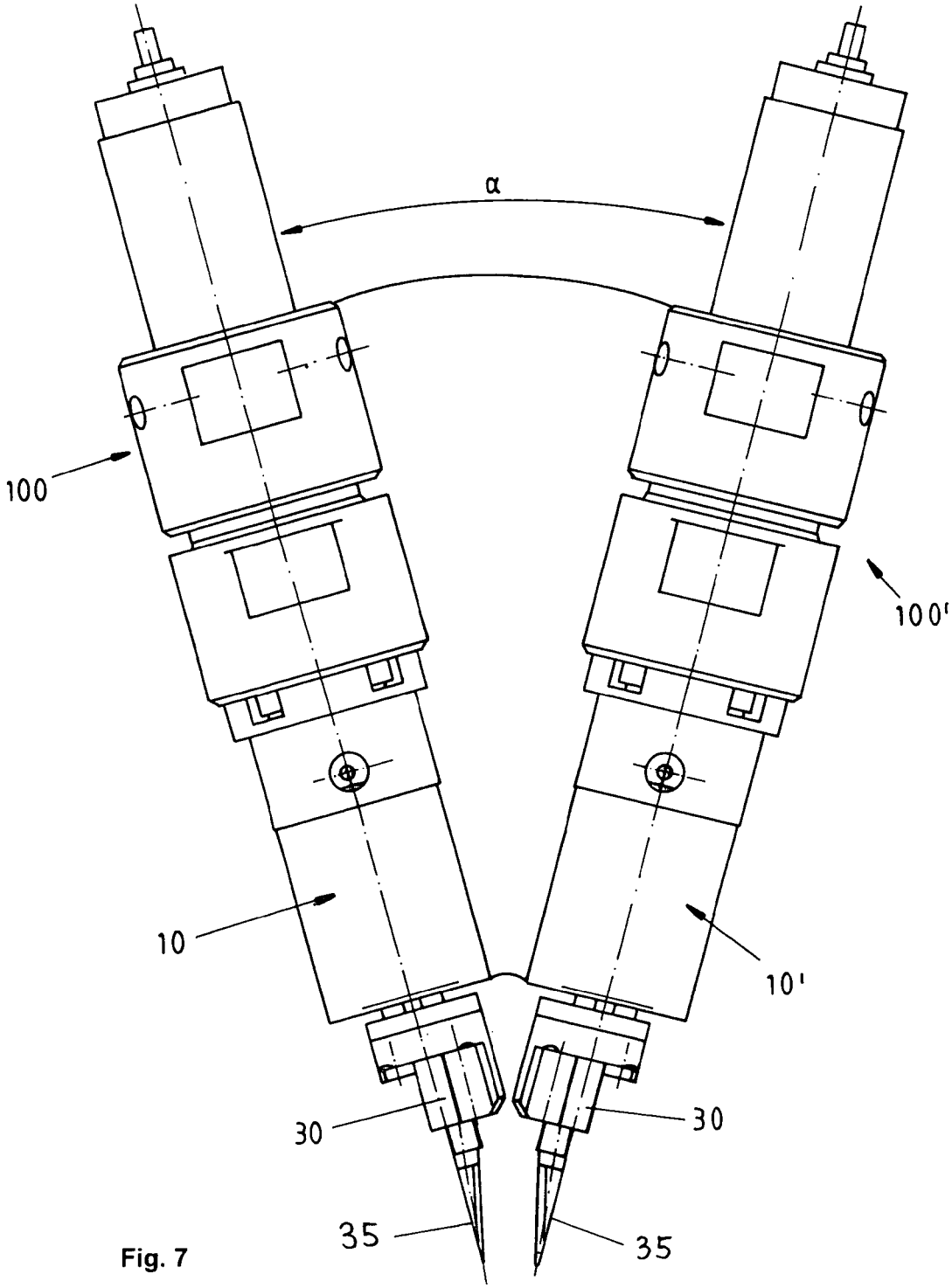
FIG. 7 shows in a view a cutting tool with two cutting heads placed at an angle to each other.
Figure 8:
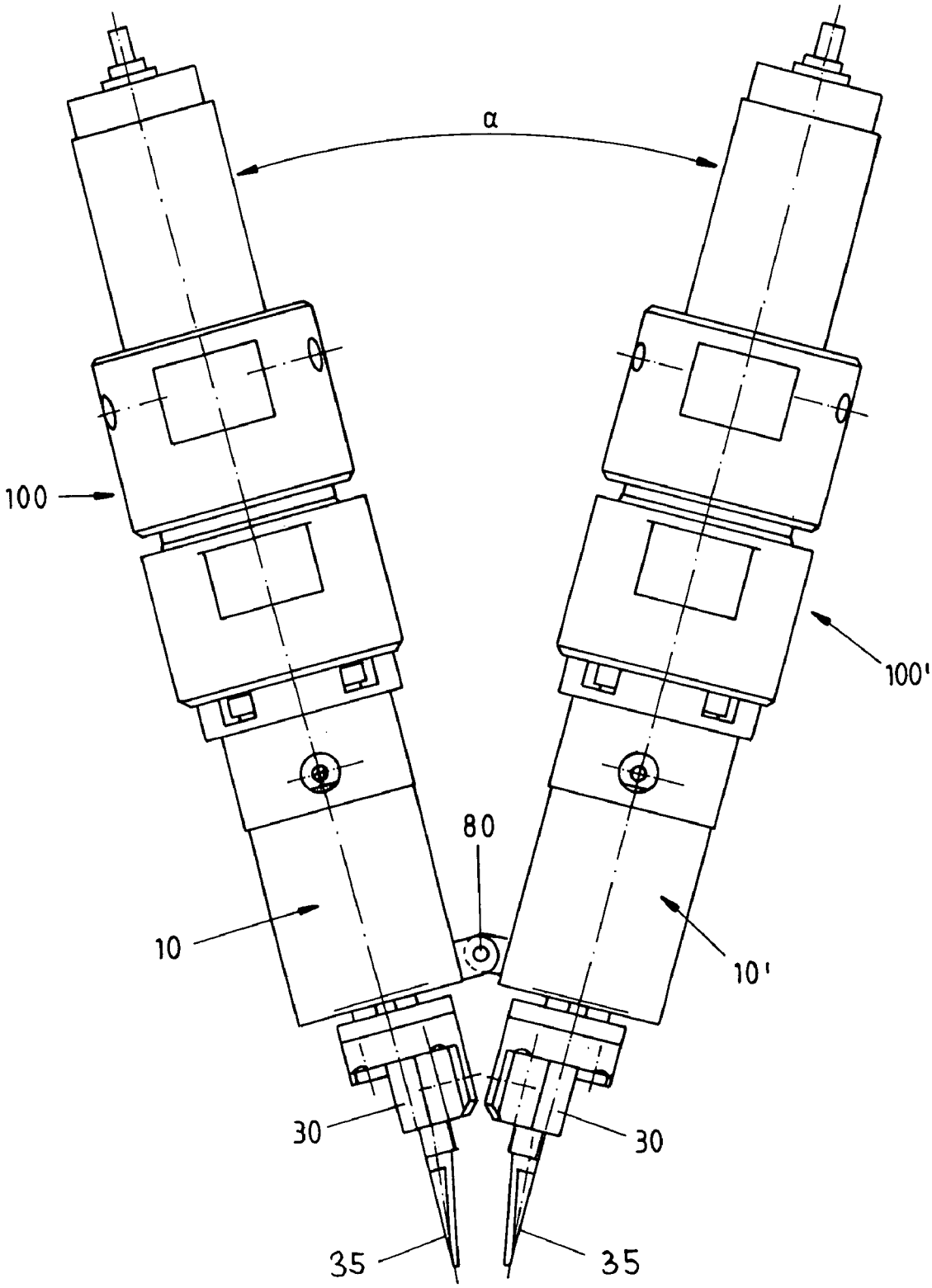
FIG. 8 shows in a view a cutting tool with two cutting heads placed at an angle to each other, whereby the angular position is changeable.
Figure 9:
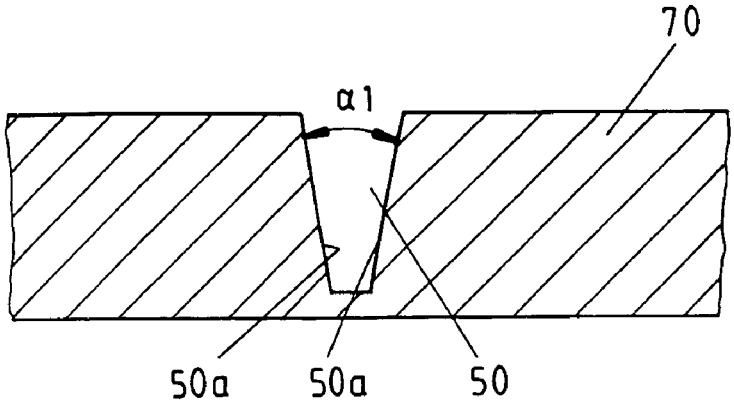
FIG. 9 to 11 show respectively schematically a vertical cut through a V-shaped filled weld made in a plastic material with a residual wall thickness in the cut area, whereby the fillet welds have different V-shaped configurations.
Figure 10:
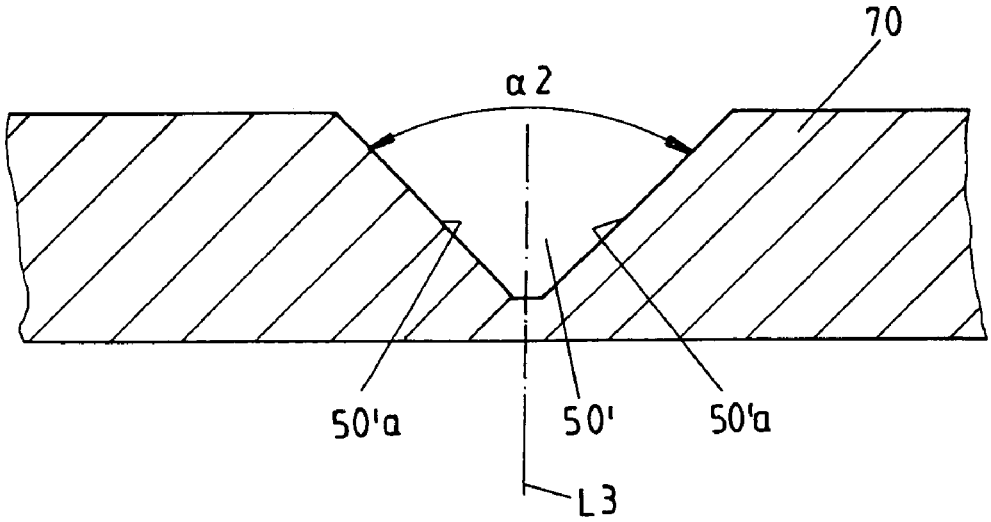
Figure 11:
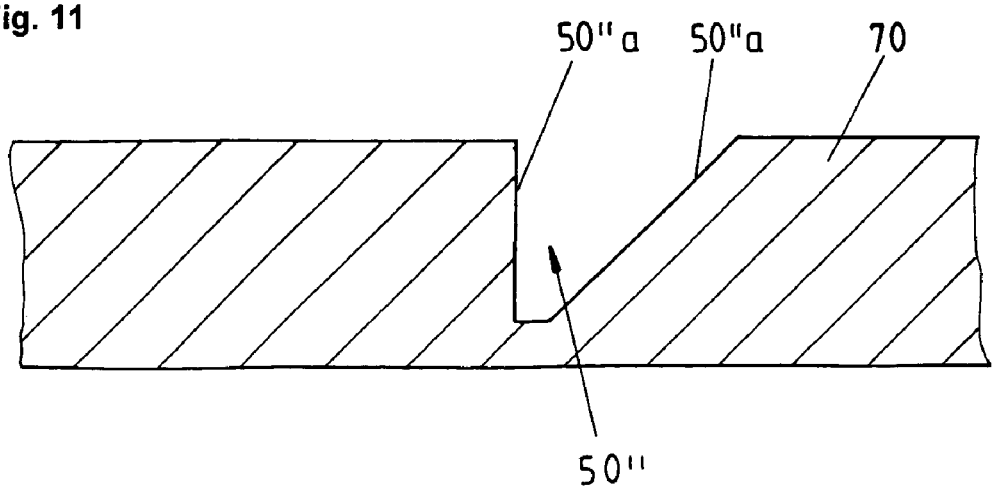
Figure 12:
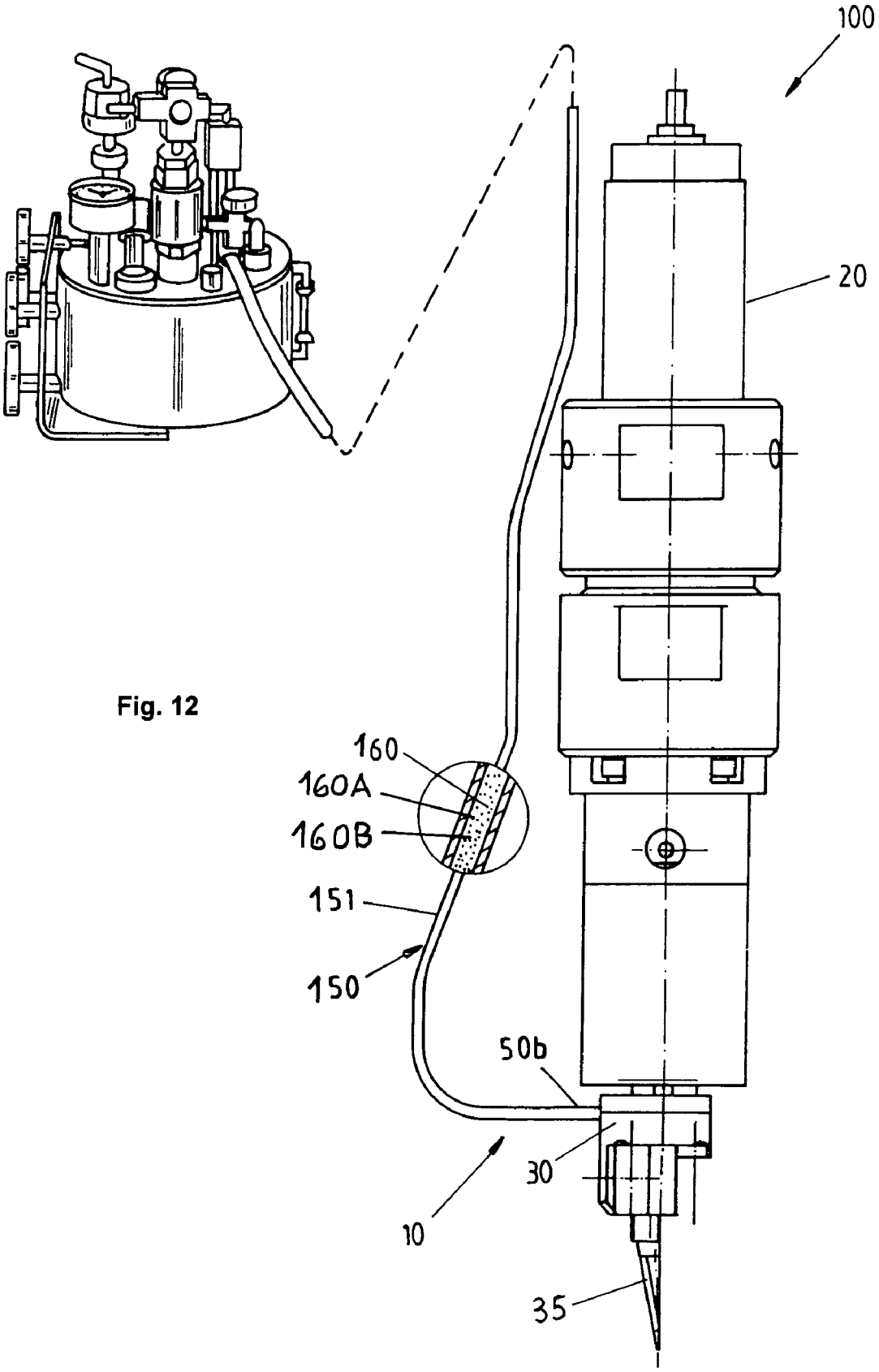
FIG. 12 shows in a view the cutting head of a cutting tool with devices for the feeding of a separating agent to the cutting knife.
Figure 13:
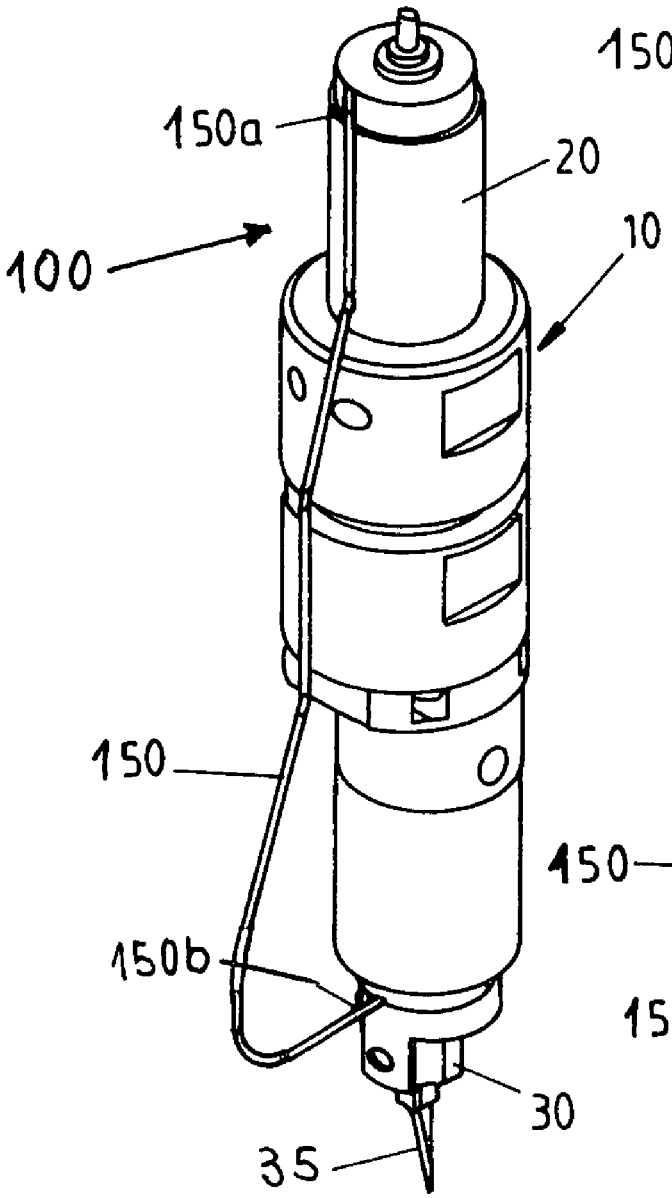
FIGS. 13 and 14 show different graphic views of the cutting head.
Figure 14:
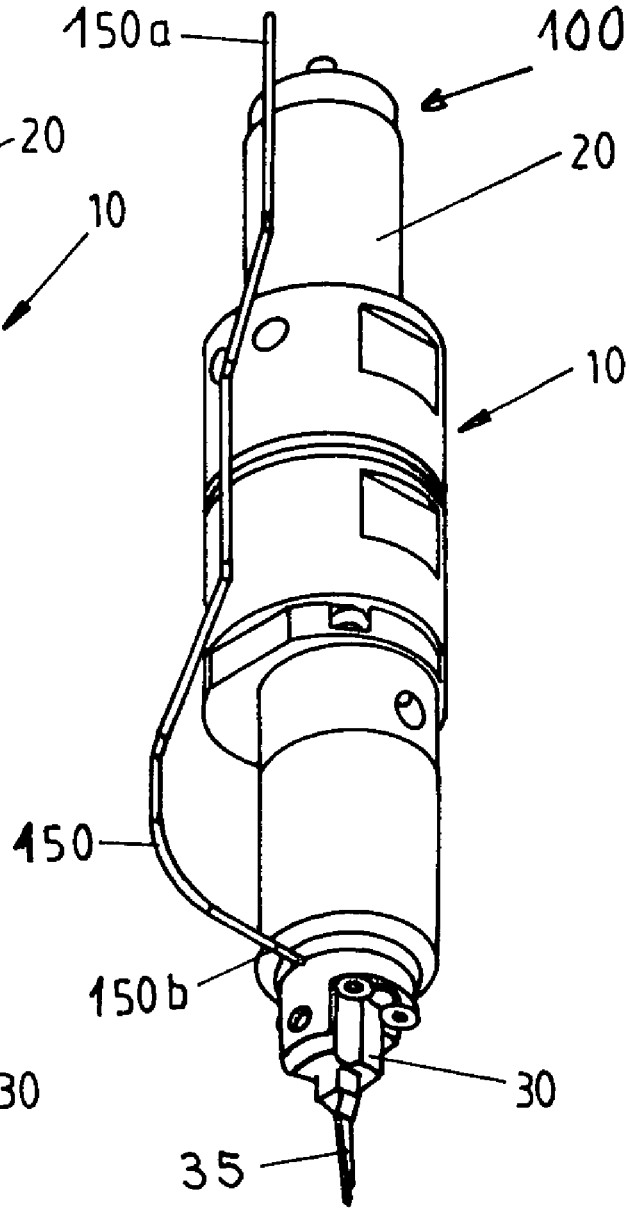
Figure 15:
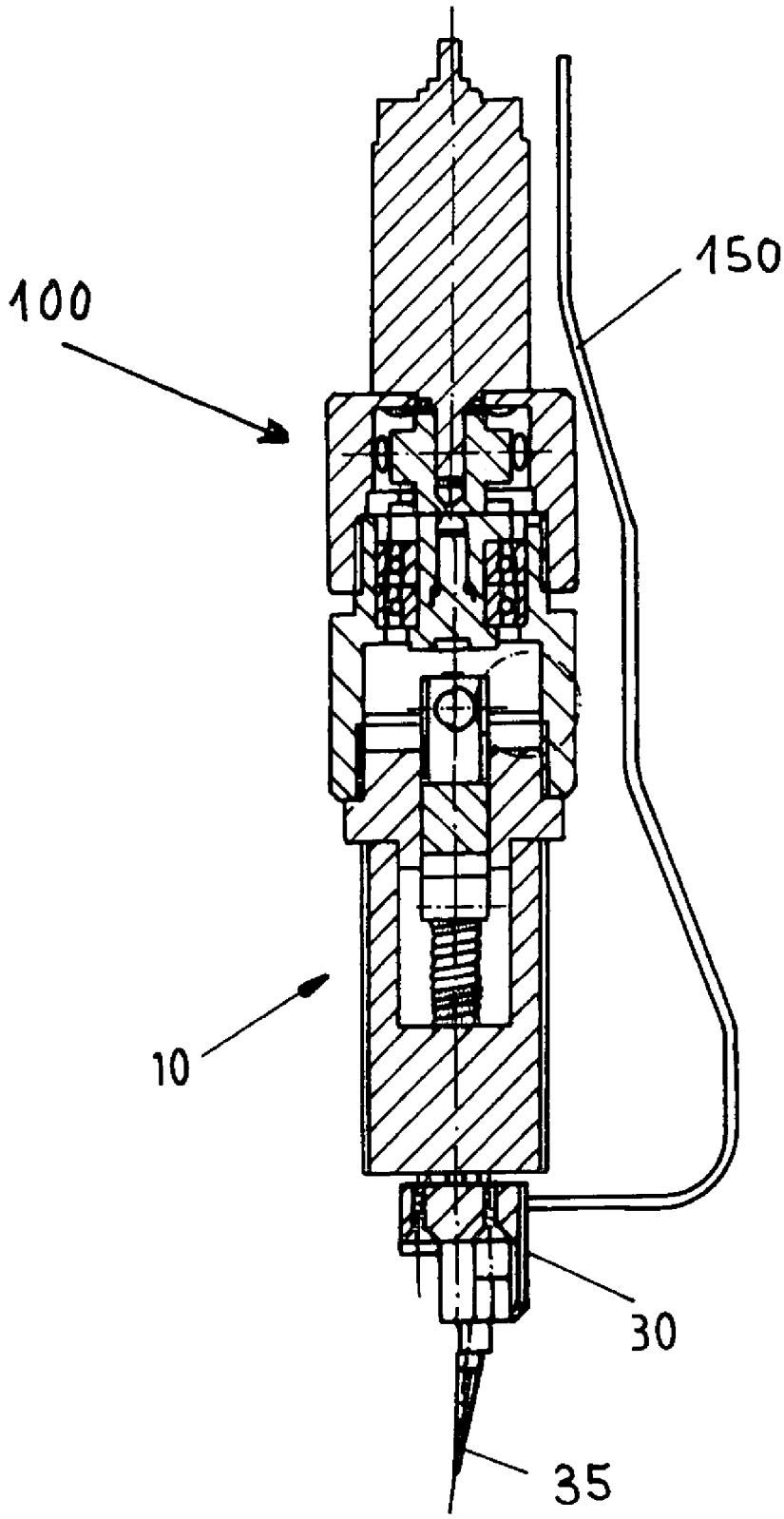
FIG. 15 shows a vertical longitudinal cut through the cutting head.

FIG. 7 shows a cutting tool 100' which has two cutting heads 101 10', whereby both cutting heads are configured alike and like the cutting head 10 as described above. Both cutting heads 10, 10' are placed in an angular position a to each other for producing V-shaped cuts 50, 50' in the material to be cut 70 so that both cutting heads 10' 10' are at an angle with their longitudinal axles L, L1. For the embodiment according to FIG. 7, both cutting heads 10, 10' of the cutting tool 100' are placed at a predetermined angle to each other, whereby the angular position of both cutting heads cannot be changed so that with this cutting tool 100' V-shaped cuts can be carried out in the material to be cut, whereby each V-shaped cut always has the same conformation, as represented in FIGS. 9 and 10. However, both cutting heads 10' 10' can also be configured according to FIG. 8 changeable in their angular position a to each other. To this purpose, both cutting heads 10, 10' are connected with each other for example in their lower area over a hinge 80. In the upper area, both cutting heads 10, 10' can also be connected with each other, namely so that the distances between the cutting heads 10, 10' in their upper areas can be changed for example by means of a regulating screw. With this embodiment, it is possible to produce V-shaped cuts 50, 50' with a different profile configuration as represented in FIGS. 9 and 10. The V-shaped cut 50 in the material 70 according to FIG. 9 has a small angular position $\alpha'$ of the side walls limiting the V-shaped cut, whereas according to FIG. 10 the V-shaped cut 50' has a bigger aperture width, i.e. the angular position $\alpha 2$ of both side walls limiting the V-shaped cut 50' is chosen bigger for this embodiment. Due to the angle adjustability of both cutting heads 100, 100', for example V-shaped cuts 50" such as those represented in FIG. 11 can also be obtained for which a side wall of the V-shaped cut 50" has a vertical position. It is also possible that the individual side walls 50*a* of the V-shaped cut 50' have different angular positions to its longitudinal axis L3 so that V-shaped profiles 50*a*, 50'*a*, 50"*a* with the most different conformation are obtained.

The cutting tool 100 according to the invention for materials, in particular for polyurethane elastomers, polyvinyl chloride, TPO or TPE is controllable manually or is program-controlled and comprises a cutting head 10 with a driving device 20, a blade holder 30 and a cutting knife 35 which is placed interchangeable in the blade holder 30 (FIG. 12, FIG. 13, FIGS. 14 and 15). The cutting tool 100 can also correspond to the cutting tool described above and represented in FIGS. 1, 2, 3, 4, 5 and FIG. 6.

The cutting tool has a feeding pipe 150 placed on the cutting head 10 or in the cutting head for a separating agent 160 to which a fluorescent substance 160A or a metallic substance 160B can also be added when a quality control of the cut in the material has to take place. The feeding pipe 150 is connected at the one end in 150*a* with the metering system 170 which is preferably configured as a micro metering system. The separating agent is metered and fed to the cutting knife 140 over this metering system. The end 150*b* of the feeding pipe which is turned to the cutting knife runs into the area of the cutting knife 35. Due to the height extension X of the outlet opening, it is possible to moisten the cut bottom as well as the side walls of the cut with the materials described above.

Figure 16:
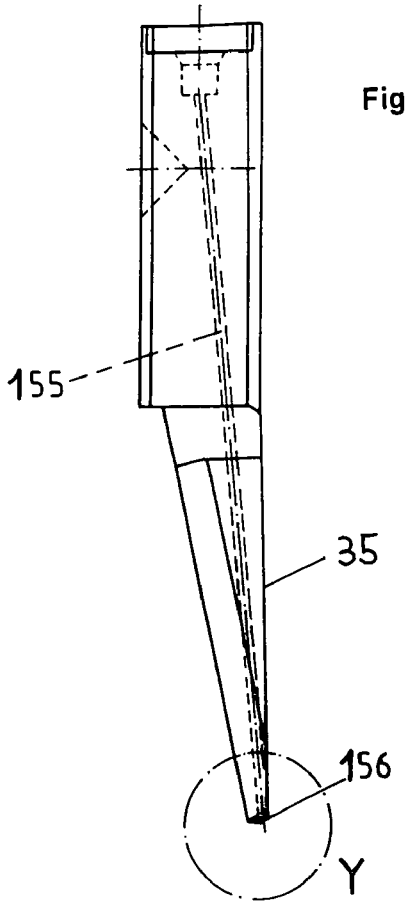
FIG. 16 shows a schematic view of the cutting head with a bore hole for feeding the separating agent.
Figure 17:
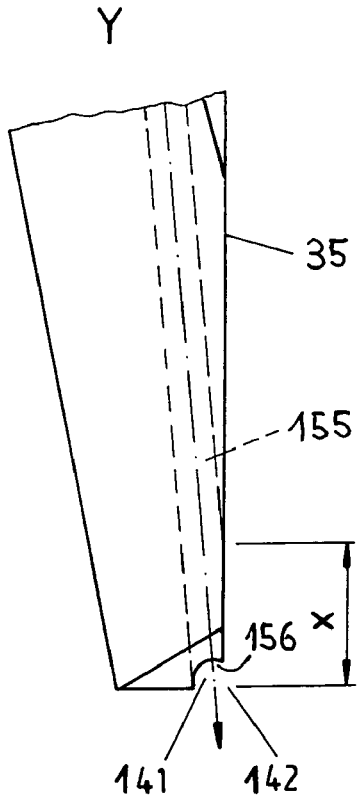
FIG. 17 shows an enlarged schematic view of the cutting knife with the separating agent outlet opening.

The feeding pipe 150 for the separating agent 160 is configured as a capillary hose 151 which runs into the blade holder 30 and which turns into a bore hole 155 which is formed in the blade holder 30 and in the cutting knife 35. The outlet opening 156 of the bore hole 155 lies in the cutting and separating area of the cutting tool 35. As FIGS. 16 and 17 show, the outlet opening 156 of the bore hole 155 in the cutting tool 35 lies in a rounded taper 141 in the corner area 142 of the cutting knife 35 so that a direct feeding of the separating agent to the cut is guaranteed.

The used separating agent 160 is configured in such a way that it avoids an automatic new glueing together of the cut in the cutting material.

Anorganic or organic fluorescent substances in liquid or solid form are added to the separating agent 160. For example fluorspar, a few uranium compounds and the salts of rare-earth elements, for example erbium, didymium, lanthanum can be used as organic substances. Benzene derivatives can be used for example as organic fluorescent substances. Fluoric chromes, fluogenes, phosphors and optical brightening agents can also be used as fluorescence colorants.

Figure 18:
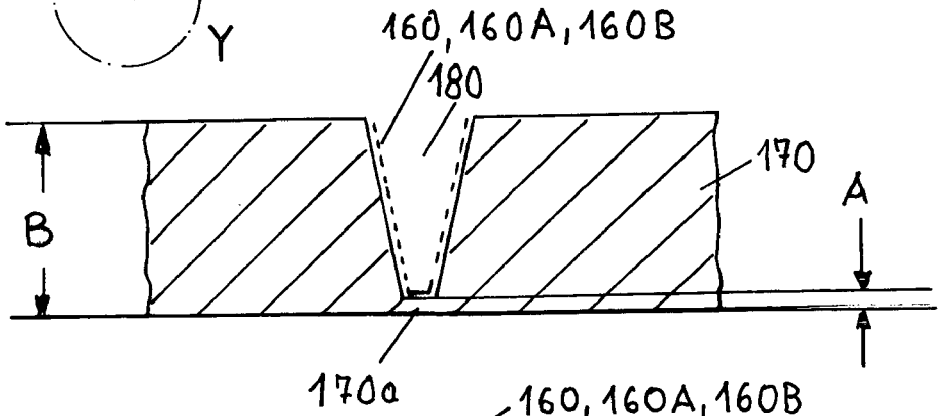
FIGS. 18 and 19 show respectively schematically a vertical cut through a fillet weld made in a plastic material with a residual wall thickness in the cut area.
Figure 19:
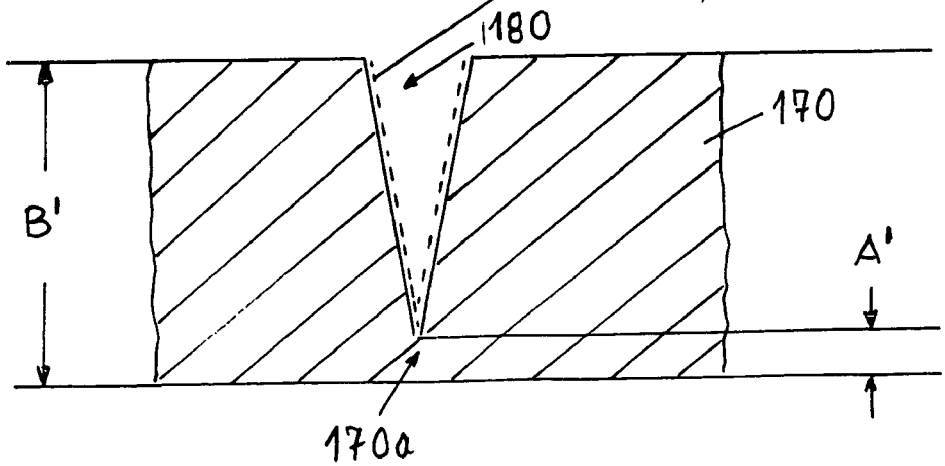

FIGS. 18 and 18 show respectively a cut (fillet weld) 180 made in the material 170 with a wall thickness B, B', the walls and bottom of the cut being moistened with the separating agent 160 to which the fluorescent substance 160A and/or the metallic substance 160B is added. The residual wall thickness A, A' of the material wall 170*a* which remains after having made the cut by cutting is then measured. The representation of the schematically shown cuts in FIGS. 18 and 19 corresponds to the opened cut directly after having passed the cutting tool. Because of the elasticity of the material, the cut has then the usual cut shape again which would just result in the risk of the glueing together again of the cut, what is effectively avoided by using the separating agent.

We claim:

1. A cutting tool for producing a cut having side walls, a bottom and a desired depth in materials which is controllable manually or program-controlled, comprising a_separating agent, at least one cutting head (10) with a blade holder (30) and a cutting knife (35) that is stationary or controlled by a driving device (20) so that the blade holder (30) with the cutting knife (35) is movable to-and fro along a cutting head longitudinal axis (L), a feeding pipe (150) with an outlet end adjacent the cutting knife for guiding the separating agent (160) to the cutting knife (35) during a cutting operation, the feeding pipe (150) being located at the cutting head (10) and having an outlet opening (156) connecting to a bore hole (155) in the cutting knife (35), the outlet openings (156) being located in the cutting and separating region of the cutting knife (35) for feeding the separating agent from the feeding pipe to the cut, the feeding pipe (150) being connected at one end thereof with a micro metering system (170), the outlet opening (156) of the bore hole (155) in the cutting knife (35) in a rounded taper (141) in a corner area (142) of the cutting knife (35) and having a height extension (X) effecting moistening of the cut bottom as well as the side walls of the cut, further comprising a driving motor with a drive shaft extending in the cutting head longitudinal axis, a cam disk connected with the drive shaft of the driving motor being mounted so as to rotate around the drive shaft longitudinal axis with control surfaces extending in different planes and mounted on opposite sides of the driving motor, a roller actively connected to the control surface of the cam disk, a lifting rod or tappet push rod actuated by a spring which is actively connected to the roller and the cam disk and having, at its free end the plate holder for the cutting knife.

2. A cutting tool according to claim 1, wherein the separating agent (160) is a marking substance that includes at least one of the group consisting of: a solid organic fluorescent substance (160A); a liquid organic fluorescent substance; a solid inorganic fluorescent substance; a liquid inorganic fluorescent substance; and a metallic substance (160B).

3. A cutting tool according to claim 1, wherein the feeding pipe (150) is configured as a capillary hose (151) which runs into the blade holder (30) and which turns into a bore hole (155) which is formed in the blade holder (30) and the cutting knife (35) and the outlet opening (156) of which lies in the cutting and separating area of the cutting knife (35).

4. A cutting tool according to claim 1, wherein the separating agent is provided so as to prevent gluing of the edges of the cut after cutting, the separating agent being a dispersion of silicones with one of waxes and oils, in a solvent mixture.

5. A cutting tool according to claim 1, wherein the feeding pipe is placed on the cutting head.

6. A cutting tool according to claim 1, wherein the feeding pipe is placed in the cutting head.

7. A cutting tool for producing a cut having side walls, a bottom and a desired depth in materials which is controllable manually or program-controlled, comprising a separating agent, at least one cutting head (10) with a blade holder (30) and a cutting knife (35) that is stationary or controlled by a driving device (20) so that the blade holder (30) with the cutting knife (35) is movable to-and fro along a cutting head longitudinal axis (L), a feeding pipe (150) with an outlet end adjacent the cutting knife for guiding the separating agent (160) to the cutting knife (35) during a cutting operation, the feeding pipe (150) being located at the cutting head (10) and having an outlet opening (156) connecting to a bore hole (155) in the cutting knife (35), the outlet openings (156) being located in the cutting and separating region of the cutting knife (35) for feeding the separating agent from the feeding pipe to the cut, the feeding pipe (150) being connected at one end thereof with a micro metering system (170), the outlet opening (156) of the bore hole (155) in the cutting knife (35) in a rounded taper (141) in a corner area (142) of the cutting knife (35) and having a height extension (X) effecting moistening of the cut bottom as well as the side walls of the cut, further comprising a driving motor with a drive shaft extending in the cutting head longitudinal axis, a cam disk connected with the drive shaft of the driving motor being mounted so as to rotate around the drive shaft longitudinal axis with control surfaces extending in different planes and mounted on opposite sides of the driving motor, a roller actively connected to the control surface of the cam disk, a lifting rod or tappet push rod actuated by a spring which is actively connected to the roller and the cam disk and having at its free end the plate holder for the cutting knife, wherein the separating agent (160) includes at least one of the group consisting of: a solid organic fluorescent substance (160A); a liquid organic fluorescent substance; a solid inorganic fluorescent substance; a liquid inorganic fluorescent substance; and a metallic substance (160B).

* * * * *